United States Patent [19]

Stefanic et al.

[11] 4,306,475

[45] Dec. 22, 1981

[54] TRIM CLEANING APPARATUS

[75] Inventors: Robert A. Stefanic, Succasunna, N.J.; James I. Malin, Joliet; Thomas A. Straub, New Lenox, both of Ill.

[73] Assignee: GAF Corporation, New York, N.Y.

[21] Appl. No.: 105,835

[22] Filed: Dec. 20, 1979

Related U.S. Application Data

[63] Continuation of Ser. No. 877,850, Feb. 15, 1978, abandoned.

[51] Int. Cl.[3] ..... B26D 7/18

[52] U.S. Cl. ..... 83/99; 83/100; 83/152

[58] Field of Search ..... 83/98, 99, 100, 103, 83/152, 154; 93/36 A

[56] References Cited

U.S. PATENT DOCUMENTS

| | | | |
|---|---|---|---|
| 3,103,842 | 9/1963 | Winkler et al. | 83/103 X |
| 3,263,882 | 8/1966 | Nugent et al. | 83/103 X |
| 3,589,224 | 6/1971 | Frantzen | 83/103 X |

FOREIGN PATENT DOCUMENTS

| | | | |
|---|---|---|---|
| 1575295 | 7/1969 | France | 83/152 |
| 47-20076 | 7/1972 | Japan | 83/152 |
| 1050360 | 12/1966 | United Kingdom | 83/103 |

*Primary Examiner*—James M. Meister

*Attorney, Agent, or Firm*—James Magee, Jr.; J. Gary Mohr

[57] ABSTRACT

A continuous automotive felt die cutting press, cuts pattern out of a web passing through it. After exit of the web from the cutting press, the cut patterns and web are passed over a perforated roller that rotates about internally segmented zones having a plurality of removable solid and perforated sleeves. The roller is capable of transmitting a vacuum or a pressure through any one of its internally segmented zones with directional and force control being partially provided by the removable sleeve placement on the segmented roller. Base guides, which are adjustable, are located in the area between the perforated sleeves to provide a solid base for the cut patterns to rest upon during their vacuum separation from the web. After vacuum separation of the cut pattern from the web the cut patterns are transported by conventional apparatus to a storage area, while the web, which remains secured to the perforated segmented roller through its vacuum stage, is separated from the roller during the rollers pressure stage and transported by conventional apparatus to a scrap storage area.

2 Claims, 4 Drawing Figures

TRIM CLEANING APPARATUS

This is a continuation of application Ser. No. 877,850, filed Feb. 15, 1978, now abandoned.

BACKGROUND OF THE INVENTION

In prior vacuum stripping operations the rollers that have been used for stripping waste from the cut patterns have operated at a low vacuum and without adjustment means to control the direction or force that the vacuum or pressure exerts upon the web. While this method has been affective in the area of fabric die cutting, where the cut is usually clean, and only requires a small amount of vacuum to separate the cut portions, it is not the case when asphalt saturated foam backed felt web is being cut, since the die cut is not usually clean and requires a high vacuum to separate the uncut and cut portions of the web. The high vacuum, however, tends to cause the asphalt felt to stick to the roller after the vacuum is released and therefore there has been a need for a release and cleaning system for the vacuum to properly separate the cut patterns from the asphalt web a solid base for backing the cut pattern is needed to prevent ripping which would normally destroy the cut patterns.

The object of this invention is to have a segmented pressure vacuum roller that is capable of exerting a high vacuum or pressure in addition to having adjustment means for directional and force control along the length of the roller.

SUMMARY OF THE INVENTION

The present apparatus is an automotive felt cutting die press, that operates in conjunction with a segmented pressure vacuum roller capable of providing vacuum and pressure force and directional control for separating cut portions of asphalt saturated foam backed felt from a web of asphalt felt as well as providing roller release and cleaning capabilities.

DESCRIPTION OF A PREFERRED EMBODIMENT

Figure 3:
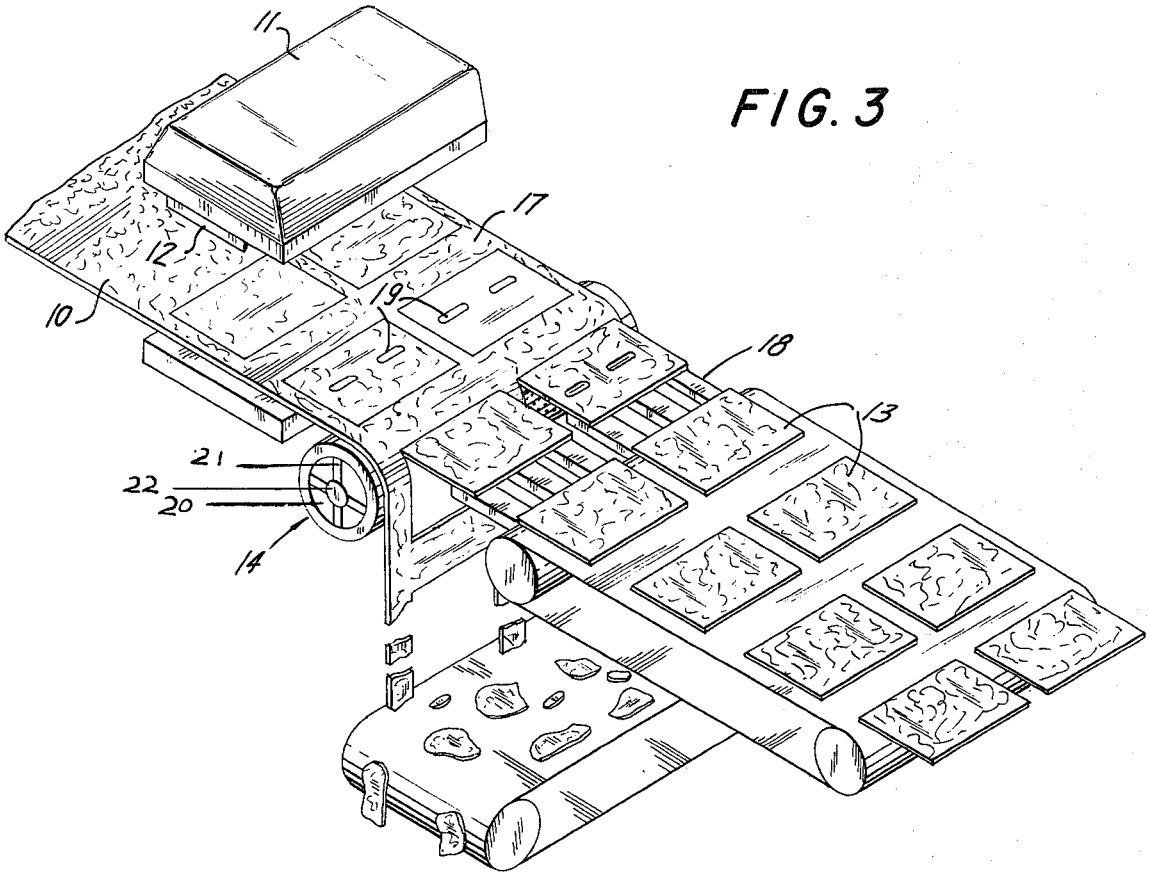
FIG. 3 is a perspective view of a die press and trim cleaning apparatus using one variable vacuum-pressure roller.
Figure 4:
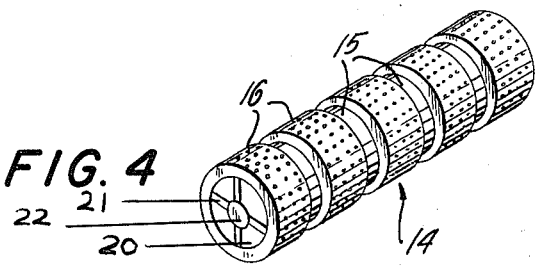
FIG. 4 is a perspective view of a variable vacuum-pressure roller.
Figure 1:
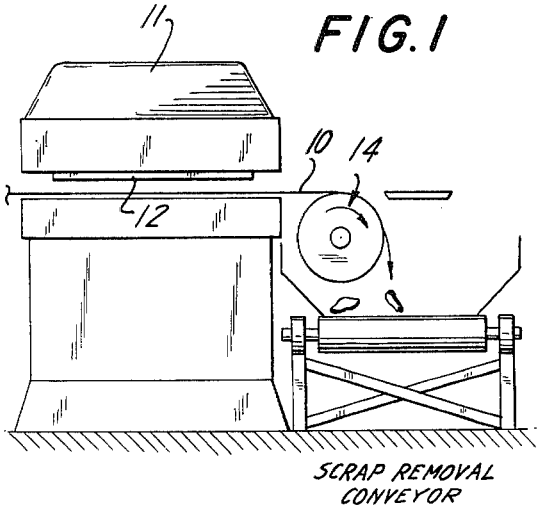
FIG. 1 is a side view of a die press and a trim cleaning apparatus using one variable vacuum-pressure roller.
Figure 2:
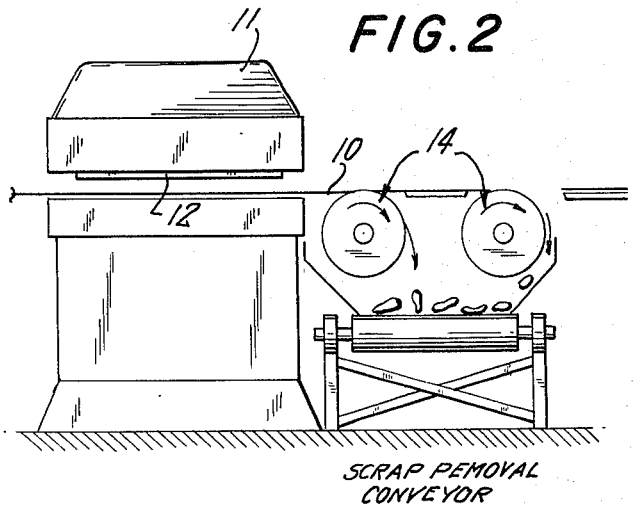
FIG. 2 is a side view of a die press and a trim cleaning apparatus using two variable vacuum-pressure rollers.

A web of asphalt saturated foam backed automotive felt 10, is feed into a cutting press head 11, containing a cutting die 12. Cutting die 12 is constructed to cut web 10 into desired patterns 13, upon activation of press head 11. The web 10 and cut patterns 13, move, after the cutting towards a vacuum-pressure roller or rollers 14. Vacuum-pressure roller or rollers 14 may be perforated over their entire surface or over only select portions of their surface and are adapted to receive removable non-perforated sleeves 15 and removable perforated sleeves 16 which may be totally perforated or only perforated in selected zones. The roller or rollers 14, however, have internally segmented zones 20, about which it rotates, representing vacuum, pressure and neutral stages of roller 14. As the felt web 10 and pattern pieces 13 cross over the revolving vacuum-pressure roller 14, that portion of said roller that is covered by perforated sleeves 16 contacts the uncut portion 17 of web 10. Base guide means 18, located between perforated sleeves 16 of roller 14, contact the cut portions 13 of web 10. The vacuum transmitted from any or all of the struts 21 or the center core 21 into all of the zones 20 through perforated sleeves 16 during the vacuum stage, holds the uncut web portion 17 of web 10 tightly to said roller 14. The cut patterns 13, are not affected by the vacuum because the non-perforated sleeves, 15 prevent the vacuum from flowing in that area. The cut patterns 13, are just prior to separation, in contact with base guides 18, which act as a support for said cut patterns 13, as the vacuum stage of the vacuum-pressure roller exerts a vacuum force upon web 10 causing separation of the uncut portion 17 from the cut patterns 13. The cut patterns 13 after separation are conveyed to a storage area by way of a conveyor belt or other conventional transport means while the uncut portions or scrap parts 17, of web 10, still secured to vacuum-pressure roller 14, pass through the pressure stage of the vacuum-pressure roller 14 causing the scrap parts 17 to be forced out of contact with the vacuum-pressure roller 14 as well as cleans the perforation on said roller. The pressure like the vacuum may be exerted through any or all of the struts 21 or through the center core 22 into any or all of the zones 20. The scraps 17, are then transferred to a scrap area by way of a conveyor belt or other conventional transport means. The vacuum or pressure exerted through the struts 21 or core 22 may be created by any conventional pressure or vacuum creating means and transmitted to said roller 14 by conventional means.

If one requires that cut patterns 13 should have portions removed, such as slots 19, this is accomplished by adding another vacuum-pressure roller 14, with sleeves 15 and 16 as well as base guides 18, placed in conjunction with one another to provide vacuum to the slot areas 19, which are to be removed, while providing support structure to the patterns 13, through base guides 18, to prevent ripping during separation of slots 19, from cut patterns 13.

We claim:

1. A continueous felt web cutting apparatus comprising a felt pattern cutting means, a first conveying means for conveying cut felt patterns as well as the felt web, a base guide means supporting the cut felt patterns located beneath said patterns, a rotating internally segmented pressure-vacuum perforated roller felt web separating means located beneath both the felt web and the base guide means, perforated and nonperforated sleeves removably mounted on said roller transmitting and restricting respectfully a flow of pressure-vacuum from the internal segments of the roller to the felt web, the base guide means being further located between the perforated sleeves and above the nonperforated sleeves, said felt web and cut patterns having contact only with the perforated sleeves and base guide means during separation.

2. A continuous felt web cutting apparatus according to claim 1 wherein the support means are comprised of a number of spaced members to give support to the cut patterns while allowing vacuum to be exerted on the felt web.

* * * * *